US007233216B2

(12) United States Patent
Kato et al.

(10) Patent No.: US 7,233,216 B2
(45) Date of Patent: Jun. 19, 2007

(54) LINE TRANSITION HAVING A NOTCH IN THE DIELECTRIC SUBSTRATE ADJACENT THE COUPLING LINE PATTERN

(75) Inventors: Takatoshi Kato, Mino-gun (JP); Atsushi Saitoh, Muko (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 50 days.

(21) Appl. No.: 10/534,460

(22) PCT Filed: Jun. 30, 2004

(86) PCT No.: PCT/JP2004/009169

§ 371 (c)(1),
(2), (4) Date: May 11, 2005

(87) PCT Pub. No.: WO2005/018039

PCT Pub. Date: Feb. 24, 2005

(65) Prior Publication Data

US 2006/0119450 A1 Jun. 8, 2006

(30) Foreign Application Priority Data

Aug. 19, 2003 (JP) ..... 2003-295386

(51) Int. Cl.
*H01P 5/107* (2006.01)

(52) U.S. Cl. ..... 333/26; 333/248

(58) Field of Classification Search ..... 333/26, 333/248
See application file for complete search history.

(56) References Cited

U.S. PATENT DOCUMENTS 5,920,245 A * 7/1999 Ishikawa et al. ..... 333/248

FOREIGN PATENT DOCUMENTS

JP 60-192401 9/1985
JP 2004-147291 5/2004

OTHER PUBLICATIONS

The PCT/ISA/210 (with English Language Translation, PCT/ISA/220, & PCT/ISA/237 Forms issued for the Parent PCT Application.

* cited by examiner

*Primary Examiner*—Benny Lee
(74) *Attorney, Agent, or Firm*—Dickstein Shapiro LLP

(57) ABSTRACT

The present invention provides a line transition and a method for manufacturing the same. The line transition is constructed such that a planar circuit can be arranged in the direction parallel to the propagation direction of electromagnetic waves propagating through a solid waveguide, the coupling characteristics of the solid waveguide with the planar circuit formed on a dielectric substrate are not influenced by the assembly precision of the waveguide and the circuit, and the line transition characteristics are not affected by a variation in manufacturing the dielectric substrate. Notches are formed at the edges of the dielectric substrate in the vicinities of coupled-line pattern segments formed on a dielectric substrate. The notches are formed by punching through holes in a ceramic green sheet serving as a motherboard, firing the motherboard, and cutting the motherboard using dicing lines passing through the through holes.

5 Claims, 5 Drawing Sheets

LINE TRANSITION HAVING A NOTCH IN THE DIELECTRIC SUBSTRATE ADJACENT THE COUPLING LINE PATTERN

CROSS REFERENCE TO RELATED APPLICATIONS

The present application is a national stage of PCT/JP2004/009169, filed Jun. 30, 2004, which claims priority to Japanese application No. 2003-295386, filed Aug. 19, 2003.

TECHNICAL FIELD OF THE INVENTION

The present invention relates to a line transition for a transmission line in the microwave band or the millimeter-wave band and a method for manufacturing the line transition.

BACKGROUND OF THE INVENTION

Japanese Unexamined Patent Application Publication No. 60-192401 ("Patent Document 1") discloses a line transition including a planar circuit formed using a dielectric substrate and a solid waveguide for propagating electromagnetic waves in a three-dimensional space to realize planar-circuit to waveguide transition.

The line transition disclosed in Patent Document 1 is constructed in such a manner that a microstrip line is formed in the dielectric substrate to realize the planar circuit and the dielectric substrate is partially inserted into an end short-circuit waveguide so as to partition the end short-circuit waveguide into two segments in a plane perpendicular to the H plane.

Japanese Patent Application No. 2003-193156, to the same assignee, discloses a line transition including a dielectric substrate arranged parallel to the E plane of a solid waveguide in almost the middle of the solid waveguide, a conductive pattern segment functioning as a cut-off region of the solid waveguide, and a coupled-line pattern segment electromagnetically coupled with standing waves generated in the cut-off region, the conductive pattern segment and the coupled-line pattern segment being included in a conductive pattern of the dielectric substrate.

In the above-mentioned line transition in which the microstrip line is inserted in the waveguide such that the microstrip line is perpendicular to the H plane of the waveguide, in order to match the impedance of the microstrip line to that of the waveguide, the reactance of the end of the inserted microstrip line on the side thereof has to be zero, the end being the coupled-line pattern segment which serves as a suspended line. To set the reactance of the coupled-line pattern segment to be zero, the matching is designed using the following two impedances:

(1) Impedance of a short-circuit portion in the waveguide (the short-circuit structure including a structure using the cut-off characteristics of the waveguide); and (2) Impedance of a portion (edge of the dielectric substrate), where the microstrip line does not exist in the dielectric substrate, in the waveguide.

The above impedance (1) is defined by the positional relationship between the coupled-line pattern segment and the short-circuit portion. The impedance (2) is defined by the positional relationship between the coupled-line pattern segment and the edge of the substrate. As will be described below, the positional relationship between the coupled-line pattern segment and the edge of the substrate has a disadvantage in that high positioning accuracy is not obtained because of a method for manufacturing the dielectric substrate.

The dielectric substrate including the above-mentioned coupled-line pattern segment is formed in such a manner that a plurality of conductive patterns are formed on a ceramic green sheet serving as a motherboard, the motherboard is fired, and after that, the fired motherboard is cut at regular intervals into individual dielectric substrates.

In cutting the fired motherboard, according to automatic dicing, a reference point is set to an arbitrary portion, e.g., one end of the motherboard, the motherboard is cut at predetermined intervals relative to the reference point. Since the motherboard is shrunk by firing, the intervals are determined in consideration of the rate of shrinkage.

However, the motherboard has a large variation in the shrinkage rate in firing. The spacings between dicing lines deviate from the corresponding conductive patterns arranged on the motherboard to be cut. Accordingly, as the distance between the dicing line and the reference point of the motherboard is longer, the deviation from the corresponding conductive pattern on the motherboard is larger. For example, when the motherboard is cut using one end thereof as the reference point, the variation in shrinkage of the motherboard significantly affects the dicing line in the vicinity of the other end. In addition, as the difference between the shrinkage rate of the motherboard in firing and a set value becomes larger, the deviation becomes more pronounced.

When the space between the edge of each dielectric substrate and the coupled-line pattern segment is different from a design value, the reactance of the coupled-line pattern segment on the side of a transmission-line pattern segment is increased, thus resulting in impedance mismatching between the solid waveguide and the planar circuit. Unfortunately, predetermined line-transition characteristics cannot be obtained.

SUMMARY OF THE INVENTION

It is an object of the present invention to provide a line transition in which a variation in the positional relationship between a coupled-line pattern segment formed in a dielectric substrate and the corresponding edge of the dielectric substrate is minimized to stabilize the characteristics of planar-circuitry to waveguide transition.

The present invention provides a line transition including a solid waveguide and a planar circuit to realize a planar-circuit to waveguide transition, the solid waveguide propagating electromagnetic waves within a three-dimensional space, the planar circuit being constructed by forming a predetermined conductive pattern on a dielectric substrate, wherein the dielectric substrate is disposed parallel to the E plane of the solid waveguide in almost the middle of the solid waveguide, the conductive pattern on the dielectric substrate includes a coupled-line pattern segment electromagnetically coupled with a signal propagating through the solid waveguide and a transmission-line pattern segment extending from the coupled-line pattern segment. The edge of the dielectric substrate has a notch in the vicinity of the coupled-line pattern segment, the notch having a side that is parallel to the signal propagation direction of the coupled-line pattern segment, the length of the side being equal to or longer than the dimension in the width direction of the E plane of the solid waveguide.

Further, the present invention provides a high frequency module including the line transition having the above structure.

According to the present invention, a plurality of the conductive patterns and through holes are formed in a ceramic green sheet serving as a motherboard such that each through hole is arranged in the vicinity of the corresponding line-coupled pattern segment at a predetermined spacing, the ceramic green sheet serving as the motherboard is fired, and the fired motherboard is cut along lines passing through the through holes, thus defining the positional relationship between each coupled-line pattern segment and the corresponding edge of the dielectric substrate.

As mentioned above, a notch is formed at the edge of each dielectric substrate in the vicinity of the coupled-line pattern segment formed on the dielectric substrate. The notches can be formed as through holes in the motherboard to be cut into individual dielectric substrates. The through holes can be formed prior to firing the motherboard. Consequently, even if dicing lines are relatively displaced in automatic dicing, the positional relationship between each coupled-line pattern segment and the notch arranged in the vicinity of the coupled-line pattern segment at the edge of the corresponding dielectric substrate is not affected by the displacement of the dicing lines. Thus, the reactance of the coupled-line pattern segment on the side of the transmission-line pattern segment equals approximately zero. This leads to the impedance matching between the planar circuit and the solid waveguide. Thus, the line transition with stable line-transition characteristics can be achieved.

The length of the side of the notch parallel to the signal propagation direction of the coupled-line pattern segment is larger than the width of the E plane of the solid waveguide. Consequently, even when the notch (through hole in the motherboard) is displaced in the signal propagation direction of the coupled-line pattern segment, the positional relationship between the coupled-line pattern segment and the edge of the dielectric substrate (notch) is constant. Thus, the stable line-transition characteristics can be obtained.

DETAILED DESCRIPTION OF THE INVENTION

A line transition according to a first embodiment and a method for manufacturing the line transition will now be described with reference to FIGS. 1A–1C, 2A–2C, 3 and 4.

Figure 1B:
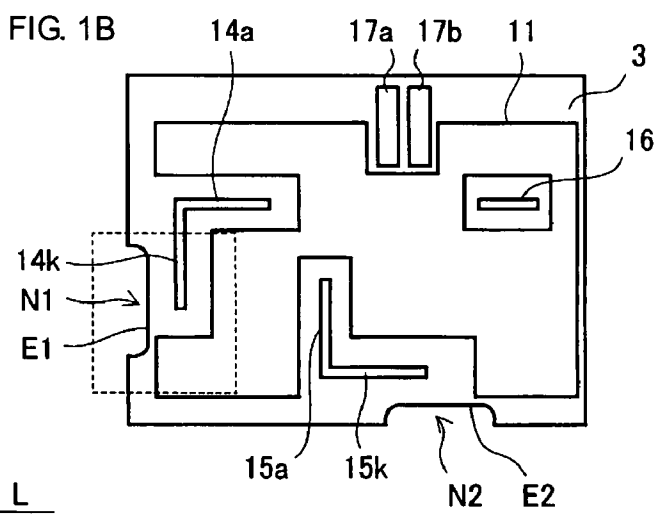
FIGS. 1A–1C are diagrams showing the structure of a dielectric substrate used in a line transition according to a first embodiment of the present invention.
Figure 1A:
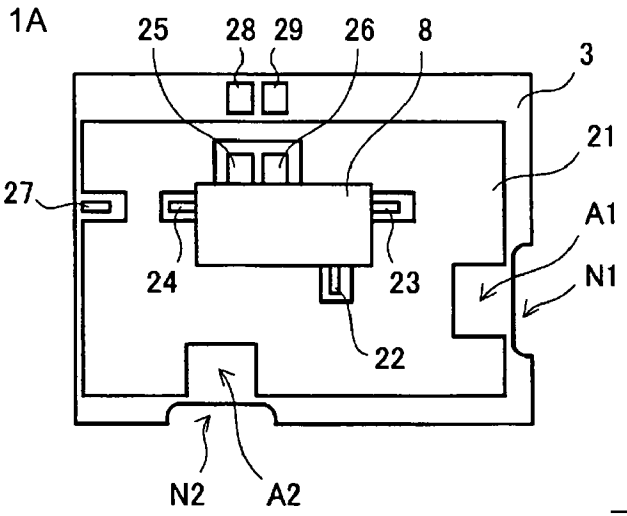
Figure 1C:
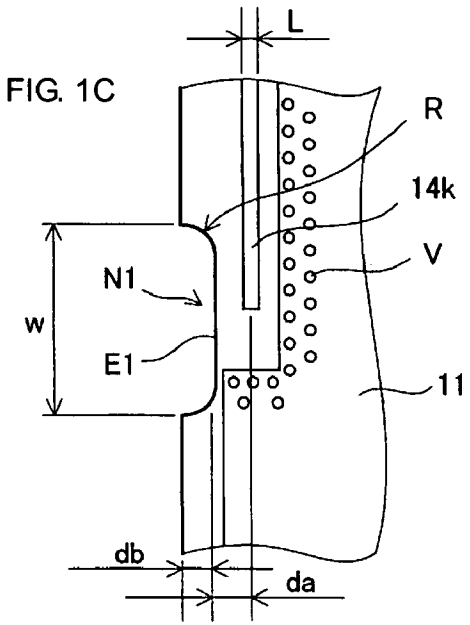

FIGS. 1A through 1C show the structure of a dielectric substrate serving as a component of the line transition. FIG. 1A is a top view of the dielectric substrate, FIG. 1B is a bottom view thereof, and FIG. 1C is an enlarged view of a portion shown by a broken line in FIG. 1B. On the upper surface of a dielectric substrate 3, a ground conductor 21, chip connection electrodes 22, 23, 24, 25, 26, and external connection terminals 27, 28, 29 are formed (FIG. 1A). Terminals of a chip 8 are soldered to the chip connection electrodes 22, 23, 24, 25, 26, respectively.

As shown in FIG. 1B, on the lower surface of the dielectric substrate 3, a ground conductor 11, transmission-line conductors 14*a* and 15*a*, coupled-line conductors 14*k* and 15*k*, transmission-line conductors 16, 17*a*, and 17*b* are formed. The coupled-line conductors 14*k* and 15*k* each correspond to a coupled-line pattern segment.

A notch N1 is formed at one edge of the dielectric substrate 3 in the vicinity of the coupled-line conductor 14*k*. Similarly, as shown in FIG. 1B, a notch N2 is formed at another edge of the dielectric substrate 3 in the vicinity of the other coupled-line conductor 15*k*. The notch N1 has a side E1 that is parallel to the signal propagation direction of the coupled-line conductor 14*k*. The notch N2 has a side E2 that is parallel to the signal propagation direction of the coupled-line conductor 15*k*.

The end of the ground conductor 11 is arranged in the vicinity of the coupled-line conductor 14*k*. A plurality of via holes V (FIG. 1C) for electrically coupling the upper and lower ground conductors 11 and 21 on the dielectric substrate 3 are formed in this edge of the ground conductor 11. Similarly, another edge of the ground conductor 11 is disposed in the vicinity of the coupled-line conductor 15*k*. A plurality of via holes for electrically coupling the upper and lower ground conductors 11 and 21 are formed in this edge.

Figure 2C:
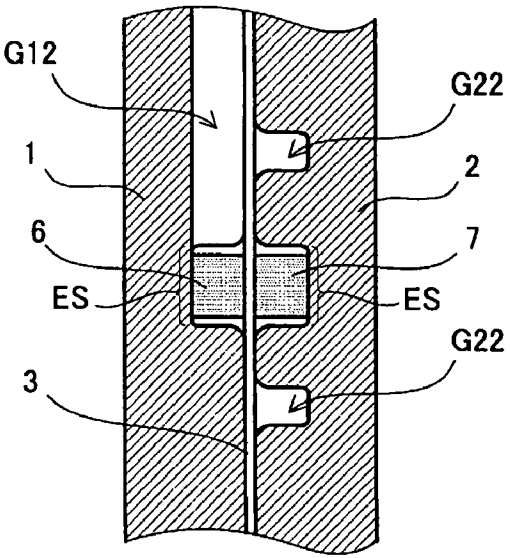
FIGS. 2A–2C are diagrams showing the structure of the line transition of the first embodiment.
Figure 2A:
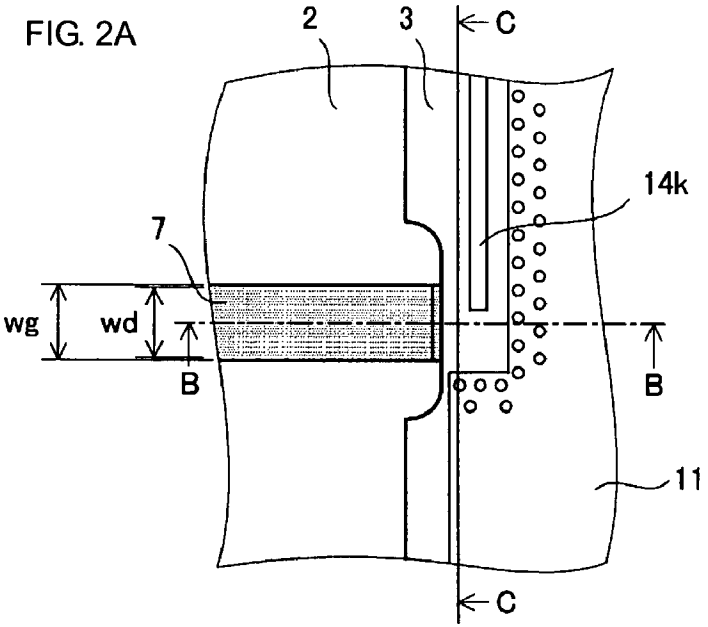
Figure 2B:
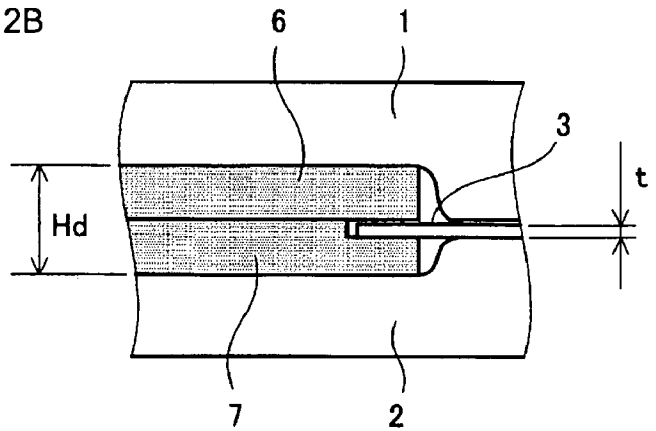
Figure 3:
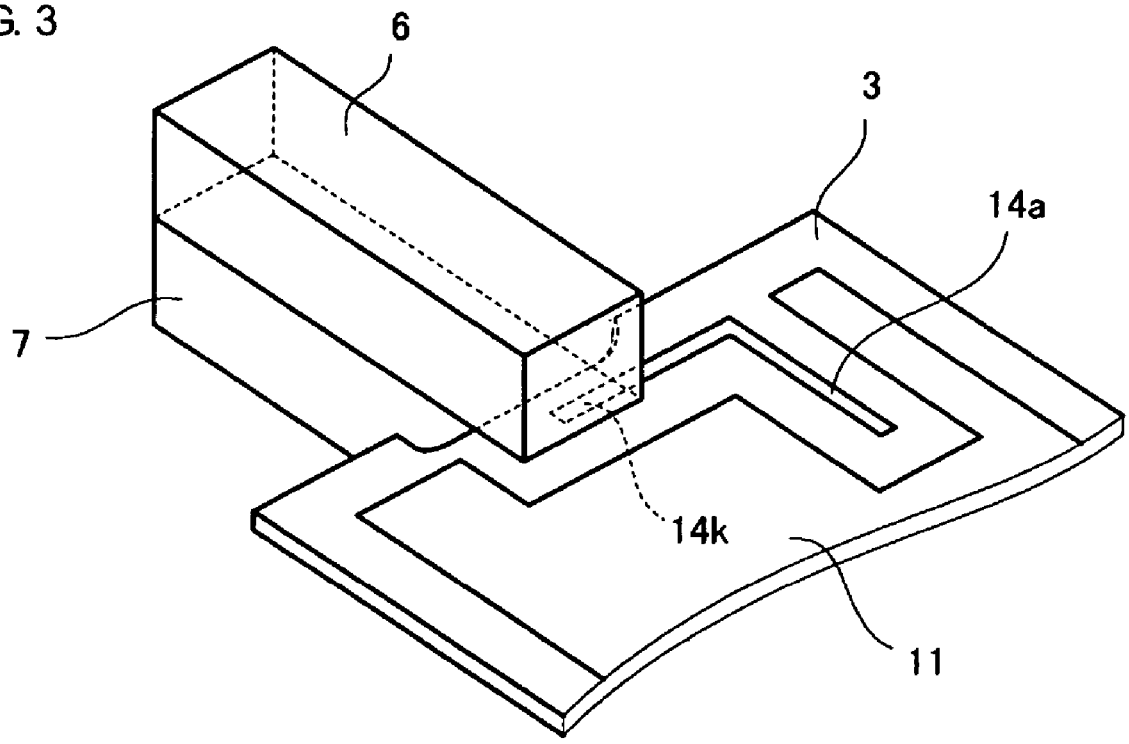
FIG. 3 is a partial perspective view of the relationship between a dielectric strip and the dielectric substrate.

FIGS. 2A through 2C show the structure of the line transition of the present invention. To show the surface on which the coupled-line conductors are formed, the line transition is turned upside down. FIG. 2A is a top view of the line transition, of which a lower conductive plate is omitted, FIG. 2B is a sectional view of the line transition at the line B—B in FIG. 2A, and FIG. 2C is a sectional view thereof at the line C—C in FIG. 1A. FIG. 3 is a partial perspective view of the positional relationship between two upper and lower dielectric strips and the dielectric substrate.

A groove to which a lower dielectric strip 6 is fitted is formed in a lower conductive plate 1. Similarly, a groove to which an upper dielectric strip 7 is fitted is formed in an upper conductive plate 2. After the lower and upper dielectric strips 6 and 7 are fitted into the grooves in the lower and upper conductive plates 1 and 2, respectively, the dielectric substrate 3 is sandwiched between the lower and upper conductive plates 1 and 2 such that the dielectric strip 6 is opposed to the other dielectric strip 7, with the substrate 3 therebetween, thus forming a dielectric filled waveguide (DFWG), which will be simply referred to as a waveguide.

A plane ES (FIG. 2C) that is parallel to each of the lower and upper conductive plates 1 and 2 of the waveguide corresponds to the E plane that is parallel to the electric field in the TE10 mode serving as an electromagnetic-wave propagating mode. In this manner, the dielectric substrate 3 is arranged parallel to the E plane in almost the middle of the waveguide.

The sides E1 and E2 of the respective notches N1 and N2 shown in FIG. 1B are parallel to the coupled-line pattern segments 14*k* and 15*k*, respectively. The length of each of the sides E1 and E2 is equal to or longer than the dimension in the width direction of the E plane ES.

As shown in FIGS. 1A and 1B, the ground electrode 21 is not formed (a space A1, A2 is provided as shown in FIG. 1A)

on the rear surface (upper surface of the dielectric substrate 3) of the portion where the coupled-line conductors 14*k* and 15*k* are formed as shown in FIG. 1B, the surface facing the lower conductive plate 1. These spaces function as a suspended line. The suspended line is electromagnetically coupled with the propagating mode of the waveguide including the dielectric strips 6 and 7 and the conductive plates 1 and 2.

In the lower conductive plate 1, as shown in FIG. 2C, a groove G12 for the transmission line is formed along the coupled-line conductor 14*k* and the transmission-line conductor 14*a* on the dielectric substrate 3. The transmission-line groove G12 provides a predetermined space adjacent to the microstrip line on the side of a signal line and also shields against another mode such as a higher order mode. A choke groove G22 is formed in the upper conductive plate 2. The conductive plate 1 with the above structure is superposed on the conductive plate 2 with the above structure, thus reducing radiation loss from a gap in the interface between the plates.

Another waveguide coupled with a suspended line corresponding to the coupled-line conductor 15*k* has the similar structure.

An example of a millimeter-wave radar module will now be described as an embodiment of a high frequency module of the present invention with reference to FIG. 6.

A signal supplied from the external connection terminal 27 shown in FIG. 1A is propagated to the connection conductor 24 through the transmission-line conductor 16 as shown in FIG. 1B. According to the present embodiment, the chip 8 in FIG. 1A and FIG. 6 includes a ×2 multiplier MLT, amplifiers AMPa and AMPb, a directional coupler CPL, and an amplifier AMPc.

Figure 6:
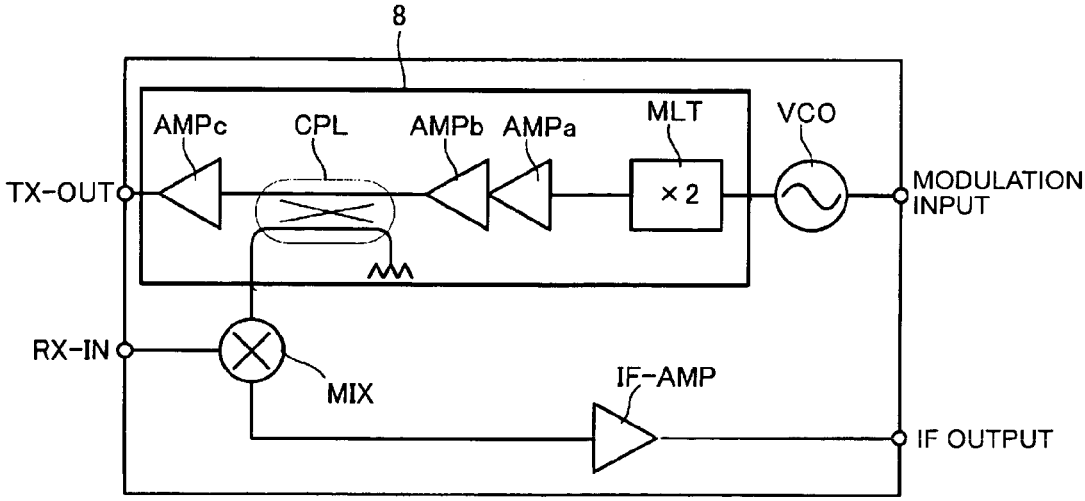
FIG. 6 is a diagram of the structure of a millimeter-wave radar module including the line transition according to the first embodiment of the present invention.

Referring to FIG. 6, a voltage controlled oscillator VCO generates a signal of a 38-GHz band and modulates the frequency of an output signal according to a modulation input signal. The ×2 multiplier MLT doubles the frequency of an input signal to output a signal of a 76-GHz band. The amplifiers AMPa and AMPb amplify the output signal of the ×2 multiplier MLT. The directional coupler CPL distributes an output signal of the amplifier AMPb at a predetermined power distribution ratio to the amplifier AMPc and a mixer MIX. The amplifier AMPc amplifies the power of the signal supplied from the directional coupler CPL and then generates the amplified signal to a transmitting unit TX-OUT. The mixer MIX mixes a signal received by a receiving unit RX-IN with the signal (local signal) supplied from the directional coupler CPL and then generates the resultant signal serving as an intermediate-frequency signal of the received signal to an amplifier IF-AMP. The amplifier IF-AMP amplifies the intermediate-frequency signal of the received signal and then generates the resultant signal as an IF output signal to a receiver circuit.

A signal processing circuit (not shown) detects distance to a target and relative speed on the basis of the relationship between the modulated signal of the voltage controlled oscillator VCO and the intermediate-frequency signal of the received signal.

Figure 4:
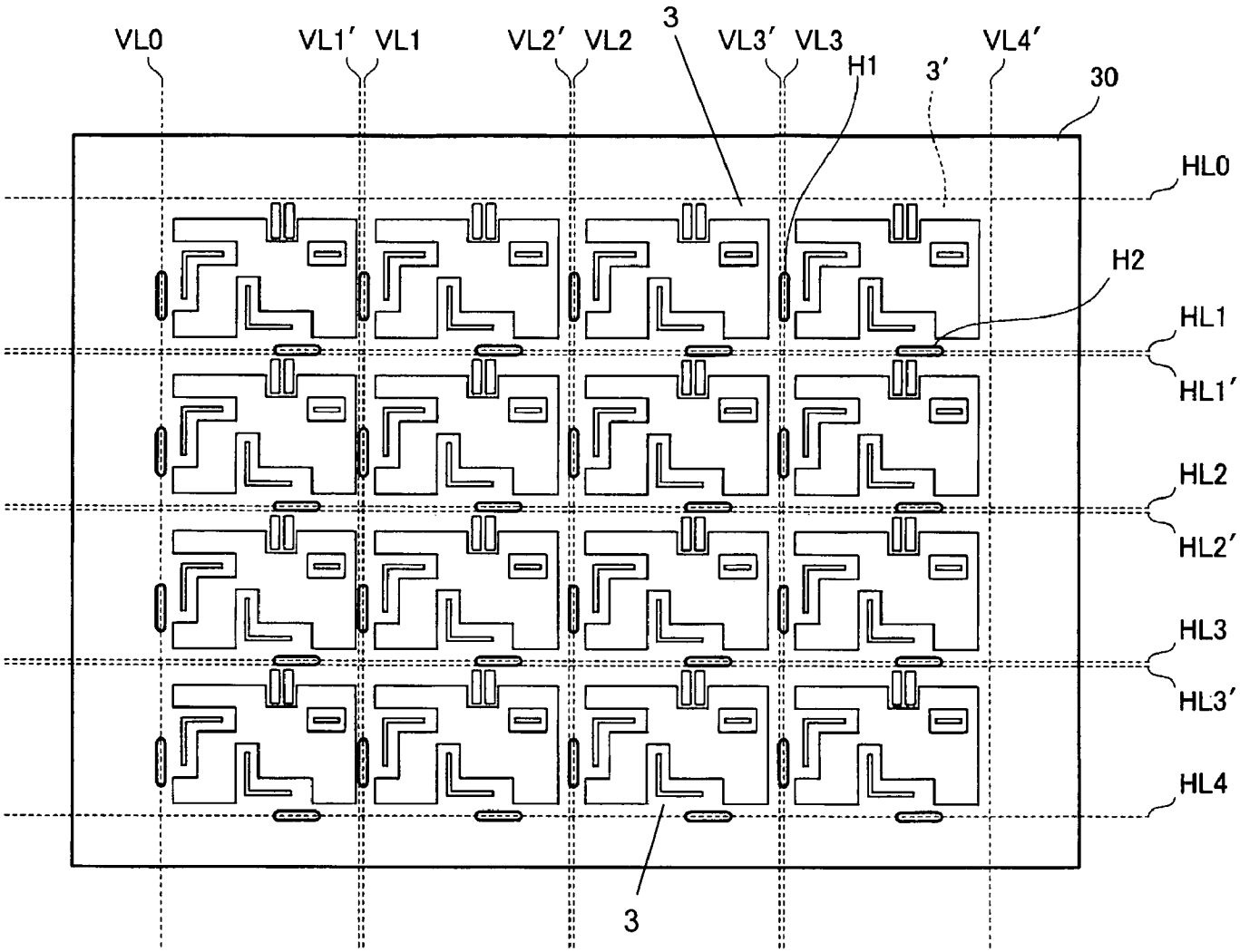
FIG. 4 is a diagram of a motherboard used in manufacturing dielectric substrates for the line transition of the present invention.

FIG. 4 shows a motherboard to be cut into dielectric substrates 3. In FIG. 4, broken lines VL0, VL1', VL1, VL2', VL2, VL3', VL3, VL4' and HL0, HL1, HL1;, HL2, HL2', HL3, HL3', HL4 indicate dicing lines of a motherboard 30. The conductive pattern shown in FIG. 1A is formed on each of workpieces obtained by cutting the motherboard along the vertical and horizontal dicing lines. Through holes H1 and H2 are formed between each workpiece and adjacent workpieces. Referring to FIG. 4, the dicing line VL3 passes through the through hole H1 formed between a right upper dielectric-substrate workpiece 3' and the adjacent dielectric-substrate workpiece on the left. The dicing line HL1 passes through the through hole H2 between the dielectric-substrate workpiece 3' and the adjacent lower dielectric-substrate workpiece.

The shrinkage rate of the motherboard 30 to be fired relatively remarkably varies depending on various parameters. The sizes of the through holes H1 and H2 are determined such that the respective dicing lines pass through formation areas of the corresponding through holes H1 and H2 even when the shrinkage rate is the highest relative to the design center or the lowest relative thereto. Thus, the spacing (da in FIG. 1C) between the notch N1 and the coupled-line conductor 14*k* and that between the notch N2 and the coupled-line conductor 15*k* in FIG. 1B can always be made uniform. Although the spacing da varies depending on the shrinkage rate of the motherboard 30, the spacing da is not influenced by the relative displacement of the dicing lines with respect to the motherboard 30. Accordingly, the variation in the spacing da presents no problem.

A method for manufacturing the line transition will now be described.

As shown in FIG. 4, a plurality of conductive patterns are formed on a ceramic green sheet serving as a motherboard by thick film printing. Subsequently, the through holes H1 and H2 are formed by a punching machine.

After that, the motherboard 30 is fired, so that the ceramic motherboard is obtained.

As shown in FIG. 4, using the vertical and horizontal dicing lines VL0, VL1', VL1, VL2', VL2, VL3', VL3, VL4' and HL0, HL1, HL1;, HL2, HL2', HL3, HL3', HL4, the motherboard 30 is cut into individual dielectric substrates 3.

The chip 8 shown in FIG. 1A is mounted on each dielectric substrate 3.

After that, as shown in FIGS. 2A, 2B, 2C and 3, the dielectric strips 6 and 7 are fitted into the grooves of the lower and upper conductive plates 1 and 2, respectively. After that, the dielectric substrate 3 is disposed between the lower and upper conductive plates 1 and 2.

When the frequency of a transmission signal is within the 76-GHz band, respective dimensions in FIGS. 1A, 1B, 1C, 2A, 2B and 2C are as follows:

w: 3.0 (FIG. 1C)
db: 0.5 (FIG. 1C)
da: 0.6 (FIG. 1C)
L: 0.2 (FIG. 1C)
t: 0.2 (FIG. 1B)
Hd: 1.8 (FIG. 2B)
wg: 1.2 (FIG. 2A)
wd: 1.1 (FIG. 2A)
R: 0.5R (FIG. 1C), where the dimensions are expressed in mm.

A line transition according to a second embodiment will now be described with reference to FIG. 5.

Figure 5:
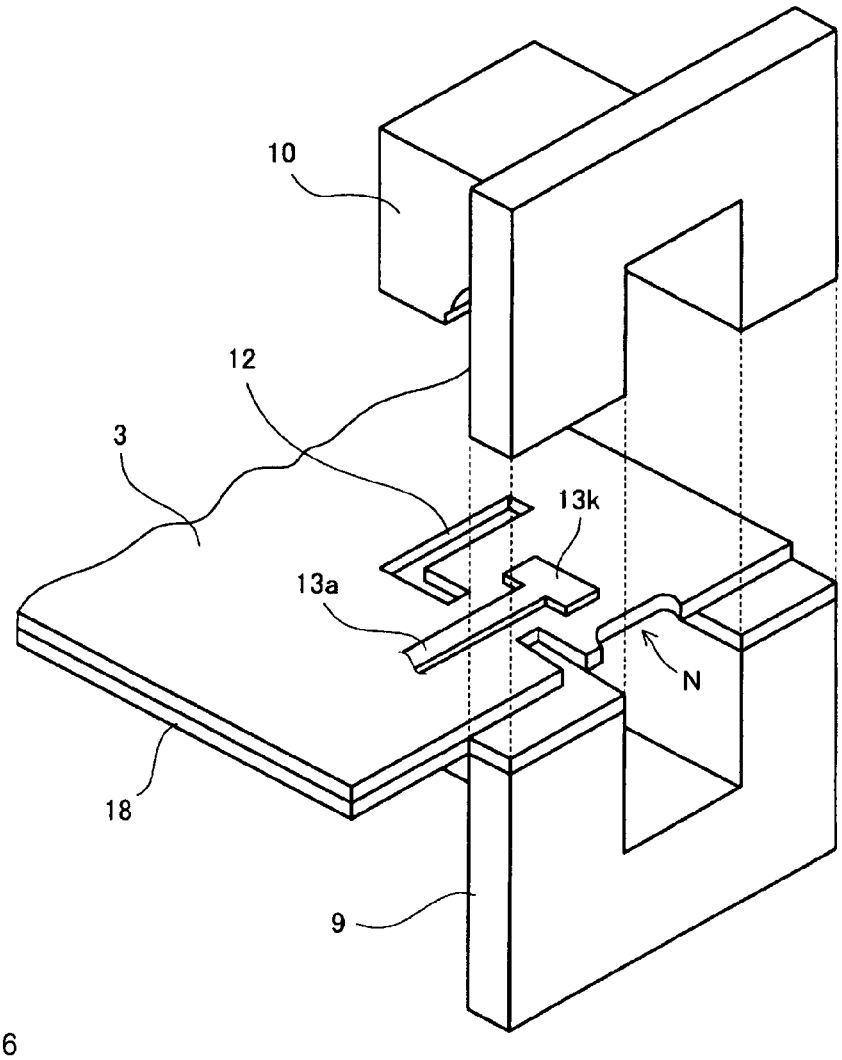
FIG. 5 is a perspective exploded view of the structure of a line transition according to a second embodiment of the present invention.

Referring to FIG. 5, a conductive pattern including a coupled-line conductor 13*k* and a transmission-line conductor 13*a* is formed on the upper surface of a dielectric substrate 3. On the lower surface of the dielectric substrate 3 excluding a portion corresponding to the coupled-line conductor 13*k*, a ground conductor is formed.

A notch N is formed at an edge of the dielectric substrate 3 in the vicinity of the coupled-line conductor 13*k*. According to the second embodiment, through holes are formed by punching a ceramic green sheet serving as a motherboard, the ceramic green sheet is fired, and after that, the motherboard is subjected to dicing, thus forming the notches N.

Upper and lower waveguide segments 9 and 10 are assembled into a short-circuit waveguide. The dielectric substrate 3 has a groove 12. The dielectric substrate 3 is disposed between the waveguide segments 9 and 10 such that the short circuit between the waveguide segments 9 and 10 occurs through the groove 12. The dielectric substrate 3 is supported by a supporting metal plate 18.

As mentioned above, the present invention can also be applied to a cavity waveguide serving as a solid waveguide.

The invention claimed is:

1. A line transition comprising:

a dielectric substrate;

a waveguide, the waveguide propagating electromagnetic waves within a three-dimensional space; and a conductive pattern disposed on the dielectric substrate, the conductive pattern including a coupled-line pattern segment electromagnetically coupled with the electromagnetic waves propagating through the waveguide and a transmission-line pattern segment extending from the coupled-line pattern segment, wherein the dielectric substrate is disposed parallel to an E plane of the waveguide, and an edge of the dielectric substrate has a notch in the vicinity of the coupled-line pattern segment, the notch having a side that is parallel to a signal propagation direction of the coupled-line pattern segment, the length of the side being equal to or longer than a width of the E plane of the waveguide, and the notch does not extend to ends of the edge of the dielectric substrate in which the notch is located.

2. A high frequency module including the line transition according to claim 1.

3. The line transition according to claim 1, wherein the dielectric substrate is disposed in substantially a middle of the waveguide.

4. The line transition according to claim 1, wherein the waveguide is a solid waveguide.

5. The line transition according to claim 1, wherein the conductive pattern is a planar circuit which accomplishes planar-circuit to waveguide transition.

* * * * *